US009885476B2

(12) United States Patent
Le Mer

(10) Patent No.: US 9,885,476 B2
(45) Date of Patent: Feb. 6, 2018

(54) SURFACE COMBUSTION GAS BURNER

(71) Applicant: Sermeta, Morlaix (FR)

(72) Inventor: Joseph Le Mer, Plouezoch (FR)

(73) Assignee: Sermeta (FR)

( * ) Notice: Subject to any disclaimer, the term of this patent is extended or adjusted under 35 U.S.C. 154(b) by 203 days.

(21) Appl. No.: 14/412,277

(22) PCT Filed: Jul. 3, 2013

(86) PCT No.: PCT/EP2013/064058
§ 371 (c)(1),
(2) Date: Dec. 31, 2014

(87) PCT Pub. No.: WO2014/006103
PCT Pub. Date: Jan. 9, 2014

(65) Prior Publication Data
US 2015/0167967 A1 Jun. 18, 2015

(30) Foreign Application Priority Data
Jul. 5, 2012 (FR) ..... 12 56467

(51) Int. Cl.
*F23D 14/14* (2006.01)
*F23D 14/58* (2006.01)
(Continued)

(52) U.S. Cl.
CPC ..... *F23D 14/14* (2013.01); *F23D 14/02* (2013.01); *F23D 14/26* (2013.01); *F23D 14/583* (2013.01);
(Continued)

(58) Field of Classification Search
CPC ..... F23D 14/586; F23D 14/26; F23D 14/583; F23D 2203/1026; F23D 14/70; F23D 14/10; F23D 14/58; F23D 2900/00012
(Continued)

(56) References Cited

U.S. PATENT DOCUMENTS 3,170,504 A * 2/1965 Lanning ..... F23C 99/00 126/92 R
3,312,269 A * 4/1967 Johnson ..... F23C 99/00 126/92 B
(Continued)

FOREIGN PATENT DOCUMENTS

DE 1529217 A1 12/1969
DE 9401152 U1 * 3/1994 ..... F23D 14/26
(Continued)

OTHER PUBLICATIONS

International Search Report for Application No. PCT/EP2013/064058 dated Nov. 19, 2013.

*Primary Examiner* — Avinash Savani
*Assistant Examiner* — Rabeeul Zuberi
(74) *Attorney, Agent, or Firm* — Lerner, David, Littenberg, Krumholz & Mentlik, LLP

(57) ABSTRACT

The invention concerns a surface-combustion gas burner comprising a combustion grate consisting of a metal sheet pierced with a series of slots. This burner is remarkable in that said metal sheet comprises a series of deflectors made in one piece with said metal sheet and protruding on the outer face of same, each deflector extending longitudinally and laterally above the entire surface of a slot, and in that each deflector comprises a guide portion for guiding the gas flow and a junction portion joining to the metal sheet, said guide portion being spaced from the metal sheet in such a way as to provide therewith at least one lateral gas ejection port, said deflectors being disposed in pairs in such a way that the lateral gas ejection ports of same face each other.

9 Claims, 6 Drawing Sheets

Figure 1:
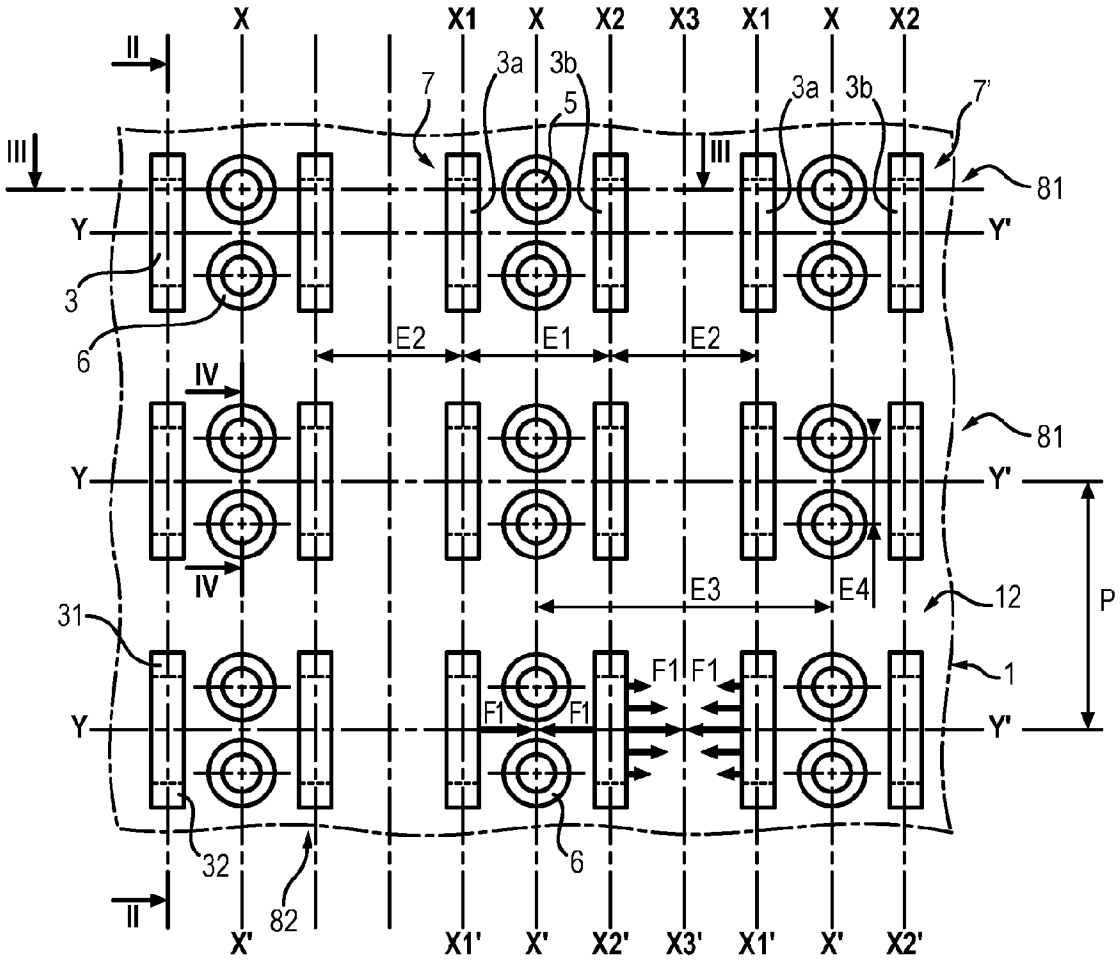

(51) Int. Cl.
*F23D 14/02* (2006.01)
*F23D 14/26* (2006.01)
*F23D 14/70* (2006.01)

(52) U.S. Cl.
CPC ..... *F23D 14/586* (2013.01); *F23D 14/70* (2013.01); *F23D 2203/1026* (2013.01); *F23D 2900/00012* (2013.01)

(58) Field of Classification Search
USPC ..... 431/329, 7, 326, 328, 354, 355; 126/91 A
See application file for complete search history.

(56) References Cited

U.S. PATENT DOCUMENTS

| | | | | |
|---|---|---|---|---|
| 3,446,566 | A * | 5/1969 | Miller | A24D 3/14 239/566 |
| 6,428,313 | B1 | 8/2002 | Rodgers et al. | |
| 2010/0139650 | A1 * | 6/2010 | Pritchard | F23D 14/105 126/91 A |

FOREIGN PATENT DOCUMENTS

| | | | | |
|---|---|---|---|---|
| EP | 0773404 | A2 | 5/1997 | |
| EP | 2037175 | A2 | 3/2009 | |
| EP | 2551590 | A2 * | 1/2013 | B32B 5/00 |
| FR | 1460836 | A * | 1/1966 | F23D 14/10 |
| FR | 1565689 | A * | 5/1969 | F23D 14/583 |
| FR | 2026995 | A1 | 9/1970 | |
| GB | 2448397 | A | 10/2008 | |

* cited by examiner

SURFACE COMBUSTION GAS BURNER

CROSS REFERENCE TO RELATED APPLICATIONS

The present application is a national phase entry under 35 U.S.C. § 371 of International Application No. PCT/EP2013/064058, filed Jul. 3, 2013, published in French, which claims priority from French Patent Application No. 1256467, filed Jul. 5, 2012, the disclosures of which are incorporated by reference herein.

The invention is situated in the field of surface combustion gas burners.

The term "gas burner"designates a burner supplied in fact with a pre-mixed gas-air mixture. In the description and claims that follow, the term "gap," used for the sake of simplification, actually designates a pre-mixed gas-air mixture.

A so-called "surface combustion" burner designates, by contrast with a torch flame humor, a burner wherein combustion takes place on a combustion surface or combustion grid, through which the gas-air mixture is routed under pressure.

This type of burner finds particular but not exclusive application in gas water heaters. The burner generates combustion gases which heat the heat exchanger through which passes the fluid to be heated.

In this type of gas burner, the flame-holding performance on the combustion surface determines the quality of the combustion of the fuel employed (gas in this case), as well as the power variation range of the burner.

Moreover, the quality of this combustion, that is the greater or lesser emission of polluting gases into the atmosphere, depends on the flame-holding performance of a burner, on the shape of the burner and on the volume of the enclosure (or combustor) wherein the combustion takes place.

"Flame-holding" designates the ability of the base of the flame to remain in proximity to the combustion surface.

Two very widespread types of surface combustion burner are already known from the prior art.

The first type of burner includes a combustion surface (or combustion grid) consisting of a stainless steel sheet perforated with small holes of varying sizes, as well as with slits of varying dimensions, Such a burner is of Cylindrical Shape, for example. The particular association of small hole regions with it regions, the cross-sections whereof are therefore larger, makes it possible to hold the flame properly, but only for a very narrow range of power variation, that is on the order of 1 to 3.

This type of burner has the disadvantages mentioned hereafter.

When this burner is used at low power, that is with a low flow rate of the gas-air premix, its surface undergoes a very strong increase in temperature, (of several hundred degrees), connected with flame contact with the sheet, which causes flashbacks into the burner, which can even lead to destruction of the latter.

Conversely, when this burner is used at high power, there is a risk, of the flame separating from the surface of the burner, which occurs when the exit speed of the gas is considerably higher than the flame propagation speed, and this has the effect of causing considerable pollutant gas emissions, particularly of nitrogen oxides (NOx) and of carbon monoxide (CO).

Considering the aforementioned disadvantages, the range of usable power setting for a given burner is therefore rather limited.

The second known type of burner consists of a perforated steel sheet, covered with a layer of stainless steel fibers placed on the outer surface of the perforated sheet. This layer of fibers has a thickness on the order of 1 mm to 2 mm and plays the role of a rather high-performance flame-holder, as well as the role of a thermal insulator to reduce the temperature rise of the perforated sheet and thus reduce the risk of flashback.

This type of burner allows a wider power variation range than the first type Of burner, that is on the order of 1 to 5, or even 1 to 10 depending on the texture of the steel fiber used. This steel fiber, however, is expensive, which increases the total cost of the burner.

The present invention therefore has the purpose of providing a surface combustion gas burner which solves the aforementioned disadvantages and which in particular allows several goals to be attained simultaneously, to wit:

- very high flame-holding performance, but with the flame slightly separated from the burner so as to reduce the temperature of its combustion surface,
- the possibility of using it over a wide power variation range,
- increased burner lifetime due to a considerable reduction in its operating temperature, this being the case at all power settings used,
- a combustion scheme that is adaptable to burners with a great variety of shapes, and both small and very large dimensions,
- a considerable reduction in pollutant gas emissions, and particularly of CO and NOx, and
- low cost, considerably less than that of a burner having a steel fiber coating.

To this end, the invention relates to a surface combustion gas burner including a combustor grid consisting of a sheet made of metal or refractory material, perforated with a series of slits.

In conformity with the invention, said sheet includes a series of deflectors integral with said sheet and protruding from its outer face, each deflector extending longitudinally and laterally above the totality of the surface of a slit; each deflector includes a gas flow guiding part and a part connecting it to the sheet, said guiding part being spaced away from the sheet so as to form with it at least one lateral gas ejection opening; and said deflectors are arranged in pairs, so that their lateral gas ejection openings face one another.

Thanks to these features of the invention, the burner can be used at very high power without separation of the flame, and conversely at very low power without flashback, which guarantees its sturdiness and its longevity.

According to other advantageous and non-limiting characteristics of the invention, taken alone or in combination:

- each deflector is shaped so that the generatrix of the inner face of said gas flow guiding part is parallel to the plane of the slit above which this deflector extends;
- said deflector is a bridge consisting of a sheet-metal strip having a central part and two ends attached to the two ends of the slit above which it extends, said central part constituting the gas flow guiding part and the two ends constituting the Dart connecting to the sheet, and two lateral gas ejection openings are provided on either side of said bridge;
- the width of each bridge is equal to the width of the slit above which it is positioned;

the ratio of the width L1 of the bridge to the height H2 of the lateral gas ejection opening is at least equal to 0.5.

said deflector has the form of a hood and includes a longitudinal part, preferably flat, for guiding the gas flow, connected to the sheet by one of its longitudinal sides.

said deflector has the form of a gill;

said sheet is further perforated with a series of ports extending into discharging micro-tubes which protrude from its outer face and the central axis whereof is perpendicular to the sheet;

the ratio of the height H3 of the portion of the discharging micro-tube protruding from the outer face of the sheet and the inner diameter P of this micro-tube is comprised between 0.2 and 2, is preferably equal to 1;

the slits and ports are grouped so as to form patterns, each Pattern including at least one port extending into a micro-tube positioned between two slits dapped by a deflector;

each pattern includes two openings each extending into a micro-tube, positioned between two slits capped by a deflector, both slits being parallel to the axis of alignment of these two parts;

said combustion grid has a cylindrical shape;

said combustion grid is of flat circular shape, of domed circular shape, or of dihedral shape.

Other features and advantages of the invention will appear from the description which will now be given, with reference to the appended drawings which show, by way of indication but without limitation, several possible embodiments of it.

Figure 2:
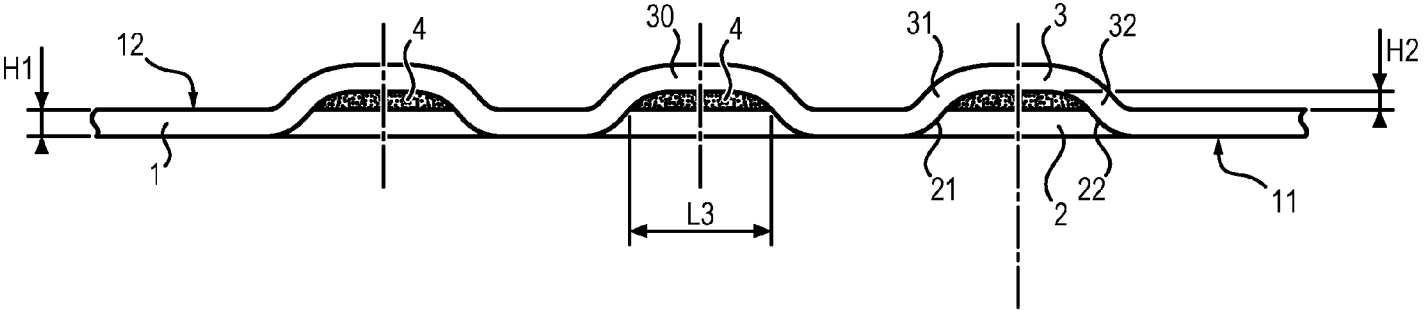
Figure 3:
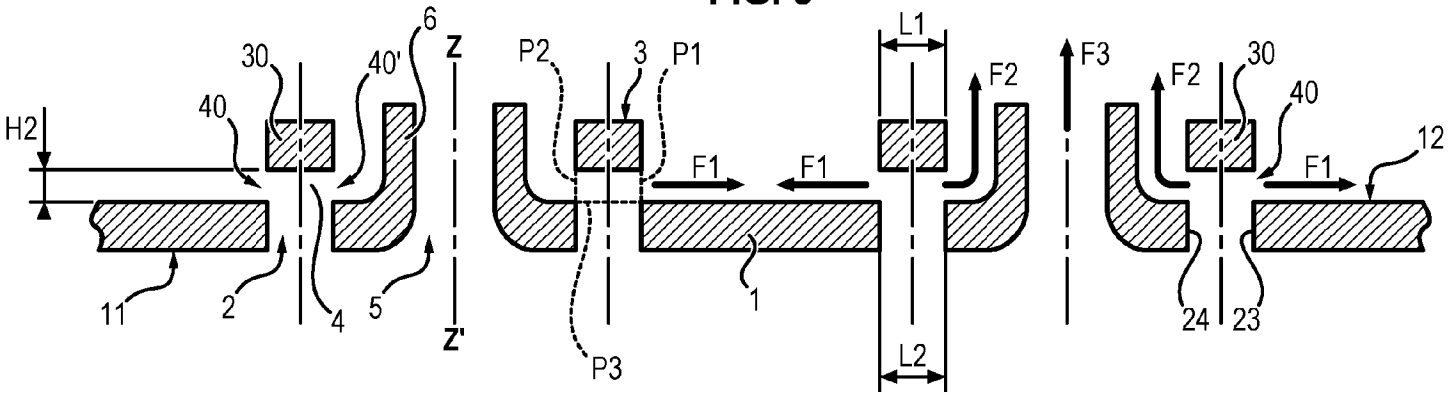
Figure 4:
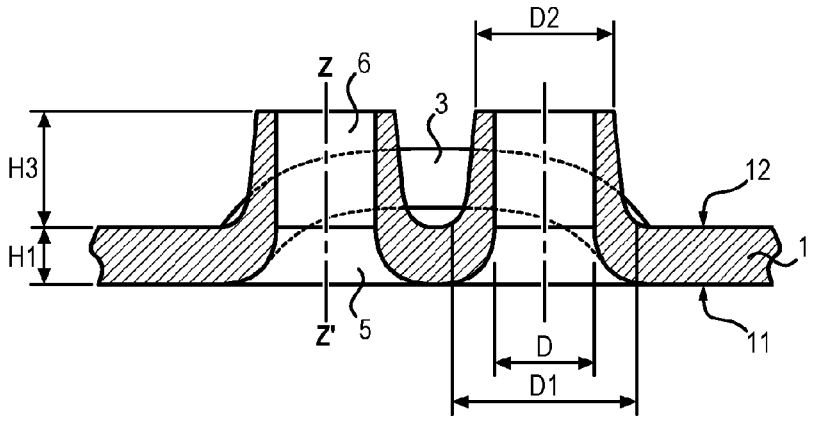
Figure 5:
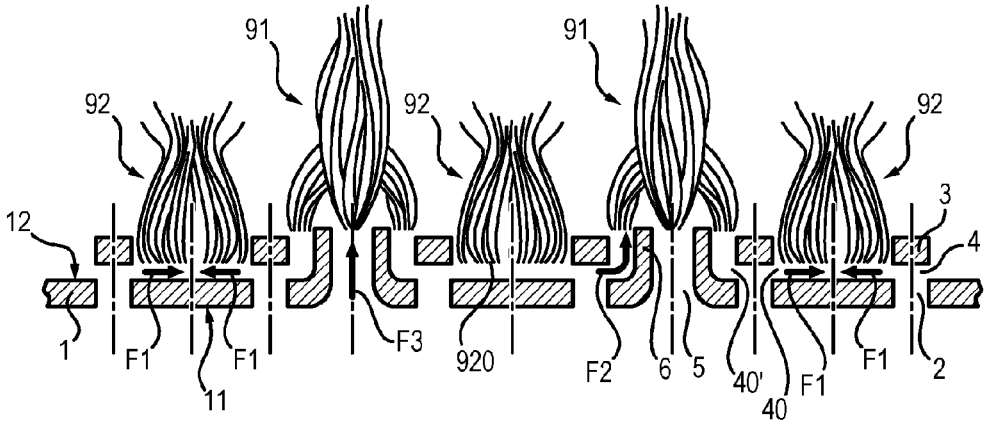
Figure 6:
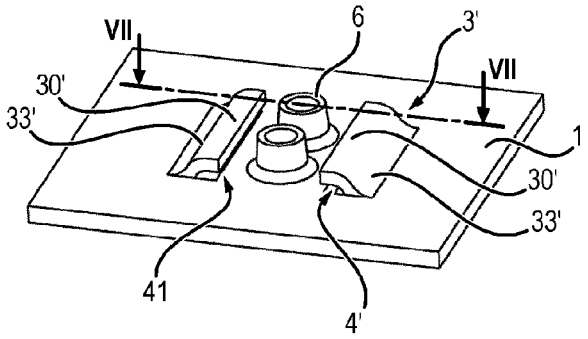
Figure 7:
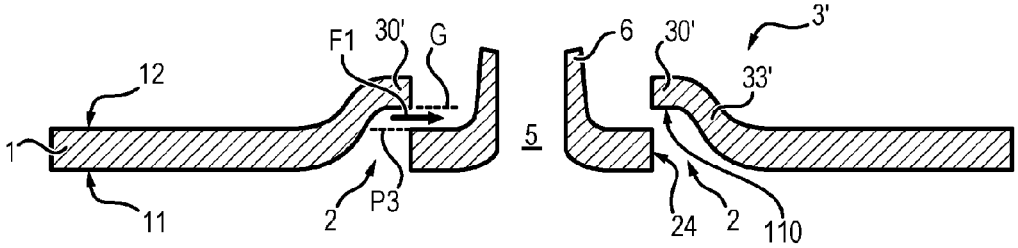
Figure 8:
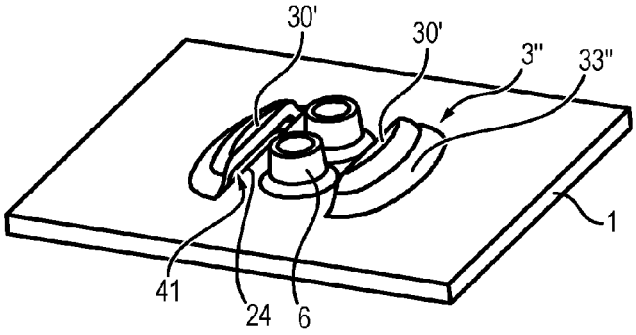
Figure 9:
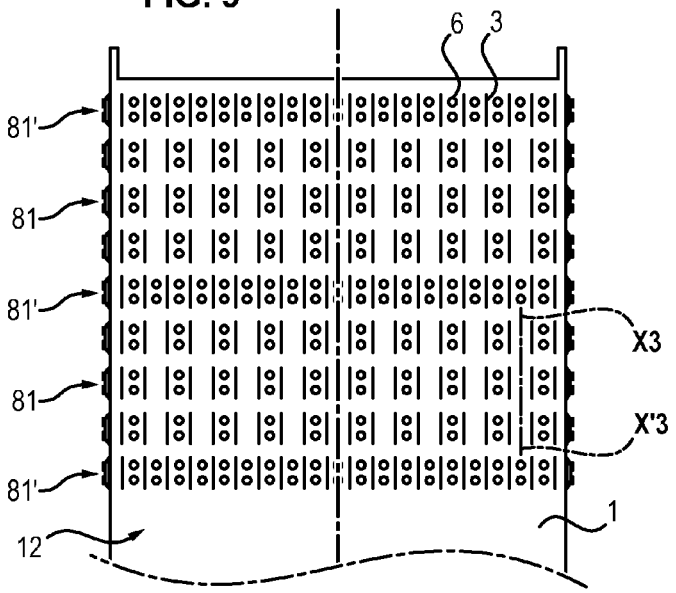
Figure 10:
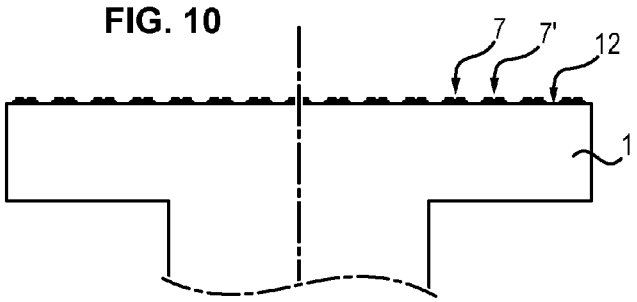
Figure 11:
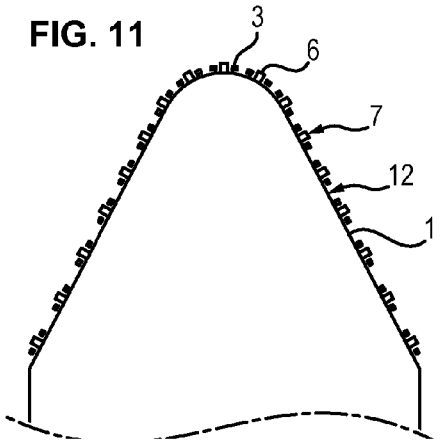
Figure 12:
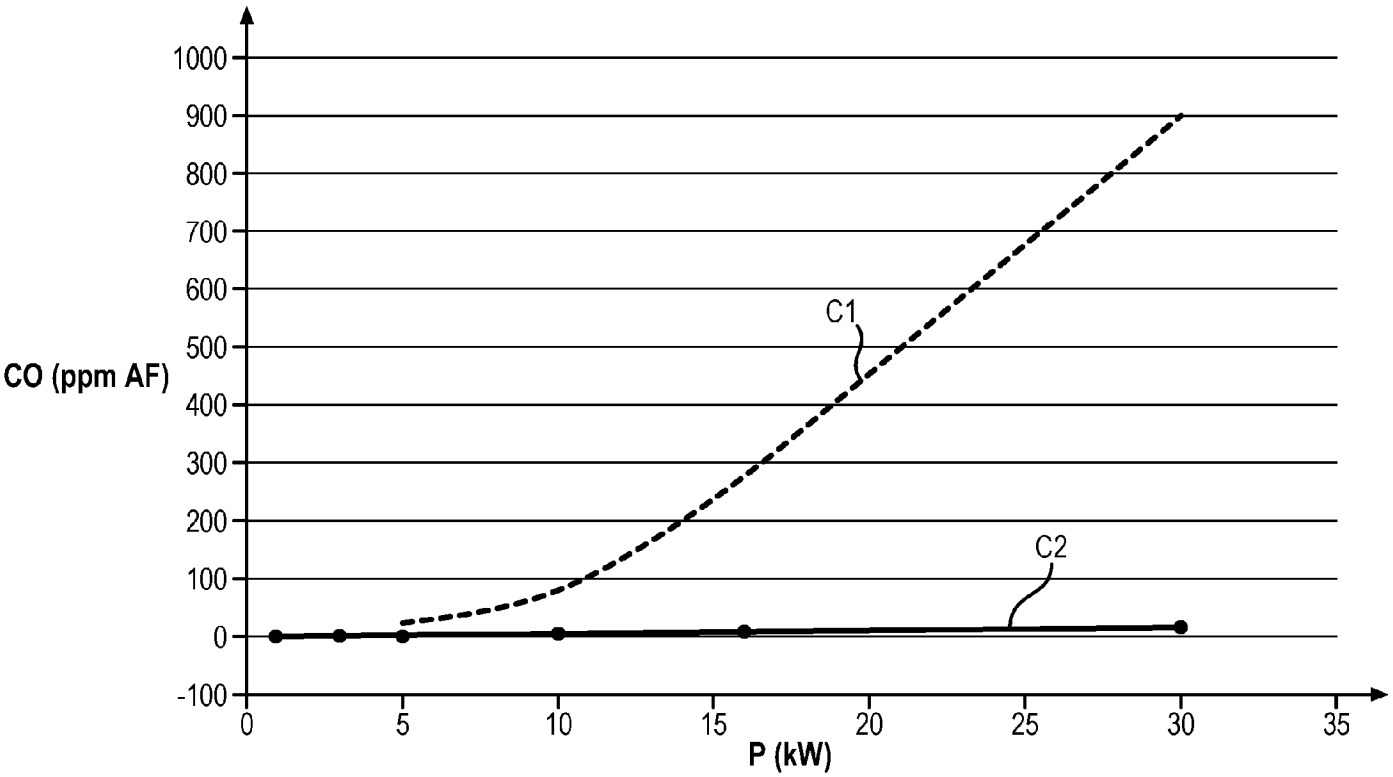

In these drawings:

FIG. 1 is a top view of a portion of the combustion grid of the burner according to the invention, FIGS. 2, 3 and 4 are section views of the same combustion grid, taken reflectively in the section planes II-II, III-III and IV-IV of FIG. 1, FIGS. 3 and 4 being at a larger scale, FIG. 5 is a schematic view showing the principle for holding the flame on the surface of the burner grid, FIGS. 6, 7 respectively are views, in perspective and in section along section plane VII-VII of FIG. 6, of a second embodiment of the openings provided in the combustion grid according to the invention, FIG. 7 being at a larger scale, FIG. 8 is a perspective view of a third embodiment of the openings provided in the combustion grid according to the invention, FIGS. 9 to 11 show different variant embodiments of the combustion grid, respectively of cylindrical shape, of flat circular shape and of dihedral shape with a rounded peak, and FIG. 12 is a graphic showing carbon monoxide (CO) emission as a function of the gas power P of the burner, for a prior art burner and one conforming to the invention.

A first embodiment of a gas burner according to the invention will now be described with reference to FIGS. 1 through 4.

This burner includes a combustion grid. It is connected to means, not shown, a fan for example, configurated for delivering a gas-air mixture, natural gas with air for example, under pressure, to the inside of the burner. The gaseous mixture passes through the openings and ports of the grid and combustion is initiated on its outside face thanks to an ignition system known to the person skilled in the art.

This combustion grid consists of a sheet (or plate) 1 made of metal, of stainless steel for example, or of refractory material. These inner and outer faces are respectively labeled 11 and 12.

This sheet 1 is perforated with a series of slits 2, of generally rectangular shape, each slit 2 having two longitudinal edges 23, 24.

Each slit 2 is capped with a bridge 3 or "little bridge", which is in one piece (formed integrally) with said sheet 1 and which protrudes from the outer surface 12 thereof.

As will be described later in more detail, the bridge 3 plays the role of a deflector for the gas passing through the sheet 1.

Each bridge 3 consists of a strip of sheet metal curved or formed so that its concavity is oriented toward the slit 2. The bridge has a central part (portion) 30 and two ends 31, 32 which are attached respectively to the two ends 21 and 22 of the slit 2 above which this bridge extends longitudinally and laterally. The central part 30 constitutes a gas flow guiding part and the ends 31, 32 a connection part to the sheet 1.

Preferably, the slits 2 are made using appropriate punching dies, not shown in the figures for the sake of simplification.

Preferably, the width L1 of the bridge 3 is equal to the width L2 of the slit 2 above which it is positioned (see FIG. 3).

The travel of the punching die defines the height H2 of a space 4, provided between the bridge 3 (more precisely its central part or portion 30) and the slit 2.

The spacing between the bridge 3 and the outer face 12 of the sheet 1 located in proximity to the bridge allows two openings (or holes) 40 and 40' to be defined, called "lateral gas ejection openings," on either side of the space 4 (see FIG. 3).

These lateral gas ejection openings 40 and 40' lie respectively in the planes P1 and P2 which are mutually parallel and also perpendicular to the plane P3 of the slit 2. In the remainder of the description and of the claims, this plane P3 of the slit 2 is taken to be at the outer face 12 of the sheet 1.

Advantageously, and as is better seen in FIG. 1, the bridges 3 are all of the same length and are arranged parallel to one another and aligned with a median axis Y-Y' which is perpendicular to them.

The different bridges 3 are therefore arranged in the form of lines 81 or row (horizontal in FIG. 1).

The bridges 3 are arranged in pairs, the lateral openings 40, 40' whereof face one another.

Also preferably, the bridges 3 in different lines 81 are aligned with a longitudinal axis X1 -X'1 or X2-X'2 perpendicular to Y-Y' , so as to define a column of bridges 82 (vertical in FIG. 1).

Advantageously but not compulsorily, the bridges 3 are arranged with a constant spacing E1 and E2 (E1=E2).

According to a simplified variant of the invention, the sheet or plate 1 is provided only with slits 2 and bridges 3. Advantageously, however, another type of perforation with a particular geometry is also practiced on the entire sheet 1.

These are ports 5 extending into discharging micro-tubes 6 which protrude from the outer face 12 of the sheet 1.

Preferably, the ports 5 are circular and the micro-tubes 6 are cylindrical, so that they have a central axis or axis of revolution Z-Z' perpendicular to the sheet 1 (see in particular FIGS. 3 and 4).

The discharging micro-tubes 6 thus constitute gas micro-injectors. These micro-tubes 6 have the effect of considerably increasing the thickness of the sheet 1 at the location where they are formed.

The ports 5 and the micro-tubes 6 are obtained for example by drawing, which has the effect of stretching the material of the sheet.

Due to this, the outer diameter D1 of the base of these micro-tubes 6, at their interface with the outer face 12 of the sheet 1, is greater than their outer diameter at the tip, D2. The thickness of the wall of the micro-tube is thus frusto-conical.

The slits/bridges and the ports/micro-tubes can be arranged and grouped on the sheet 1 so as to form different patterns 7.

According to a preferred variant embodiment of the invention shown in FIG. 1, the micro-tubes 6 are grouped in pairs and are aligned two by two along an axis X-X', while a slit 2 and a bridge 3 are positioned on either side of this pair of ports 5/micro-tubes 6, so that their longitudinal axes X1-X'1 or X2-X'2 are parallel to the axis X-X'.

It is also possible to have only one micro-tube 6 or more than two between the two bridges 3.

Moreover, these patterns 7 can be arranged and repeated over the plate 1 so that the spacing E1 between the longitudinal axes X1-X'1 and X2-X'2 respectively of the left 3*a* and right 3*b* bridges of a first pattern 7 is equal to the spacing E2 between the longitudinal axis X2-X'2 of the right bridge 3*b* of this pattern 7 and the longitudinal axis X1-X'1 of the left bridge 3*a* of a second adjoining pattern 7' located to the right of the first pattern 7. In other words, the spacing E3 between two alignment axes X-X' of micro-tubes 6 is twice the value of the spacing E1 between two, left 3*a* and right 3*b* in bridges of one and the same pair. This feature is not compulsory.

In the example shown in FIG. 1, it is observed that there are no ports 5 and mico-tubes 6 between the right bridge 3*b* of a first pattern 7 and the left bridge 3*a* of the adjoining pattern 7'. In other words, along an axis X3-X'3 parallel to X2-X'2, there are no gas exit ports. Such an arrangement thus makes it possible to increase the flow of as in the portion of the burner having patterns 7 and 7', and conversely to provide the zones with axes X3-X'3 where there is little gas release.

However, as can be seen in FIG. 9 which shows an exemplary embodiment wherein the burner has a cylindrical shape, it is also possible to provide pairs of openings 5/micro-tubes 5 between the totality of the bridges 3. A zone or raw 81' with a very high coefficient of transparency is thus obtained, as opposed to the rows 81 with a low transparency coefficient where the ports 5 and the micro-tubes 5 are absent from lines X3-X'3. These rows with differences in their coefficients of transparency can be alternated in different ways. The transparency coefficient refers to the ratio between the total area of the ports and the total area of the plate 1.

Other variant embodiments can also be contemplated. For example, FIG. 11 shows the case of a burner with a flat circular surface. In this case, the different rows 81, or 81', of patterns 7, are aligned parallel with one another. However, it would also be possible to provide for a radial arrangement in which all the different axes X-X', X1-X'1, X2-X'2 and X3-X'3 would be radial and intersecting at the center of the circular burner.

It will be noted that the dimensional proportions of the slits, bridges, ports openings and micro-injectors play a role in the desired result of improving combustion performance.

Thus preferably the ratio L1/H2 is at least equal to 0.5. Also preferably, the ratio H3/D is comprised between 0.2 and 2, more preferably equal to 1.

Other embodiments of the deflectors, other than the bridges 3, will now be described in connection with FIGS. 6 through 8.

According to a first embodiment shown in FIG. 6, the deflector labeled 3' has the general shape of a "hood" or "awning" and includes a preferably flat longitudinal portion 30' which extends longitudinally above the totality of the length of the slit 2 and which makes it possible to guide the gas flow. It is connected, along one of its longitudinal sides, with the sheet 1 with which it is integrally formed, by an arched portion 33'.

A space 4' is provided between the portion 30' and the slit 2 and there is a single lateral gas ejection opening 41 between the portion 30' and the sheet 1.

These two deflectors 3' are positioned facing one another, so that their respective openings 41 are facing one another. When the micro-tubes 6 are present, the two deflectors 3' are also advantageously parallel to the alignment axis X-X' of said micro-tubes.

According to a second variant embodiment shown in FIG. 9, the deflector has the shape of a "gill" 3" which differs from the awning or hood 3' by the circular-arc shape of its portion 33" connecting to the plate 1.

Finally, it will be noted that whatever the technique and/or means for producing the deflector(s) 3, 3', 3", these cover the totality of the surface area of the slit 2.

The view of FIG. 1 shows only a portion of the sheet 1, viewed from top, hence flat. However, the burner made from this sheet can have different geometric shapes.

According to one preferred variant embodiment shown in FIG. 9, the combustion grid of the burner has a cylindrical shape; its upper face is plugged by a disk and its side wall has the perforation patterns 7, 7' described previously. It will be noted that it would also be possible to provide these patterns only on a circular arc portion of this cylinder.

Advantageously, the axes X1-X'1 and X2-X'2 of the bridges (and hence of the slits 2) are parallel to the axis of revolution of the cylindrical burner.

FIG. 10 shows a burner the combustion grid whereof is circular and flat. Although this is not shown, this grid can also be slightly domed, so that its outer surface is convex, its concavity being oriented toward the gas supply (toward the bottom of FIG. 10).

Finally, as shown as in FIG. 11, the plate 1 can be slightly arched longitudinally in a dihedral shape, so as to exhibit a substantially triangular straight section with a rounded upper point.

The operation of the burner conforming to the invention is the following.

As can be seen in FIGS. 3 and 5, the gas escape through a port 5 and from the micro-tube 6 takes place in a direction perpendicular to the plane of the sheet and hence to its outer face 12 (arrow F3).

Moreover, the gas which leaves the slit 2 perpendicularly to the plane of the sheet 1 hits the deflector, more precisely its central gas flow guiding part 30, which extends above the entire surface area of said silt, so that it cannot escape perpendicular to the sheet 1.

For this reason, the escape of the gas occurs to either side of the bridges 3, through lateral gas ejection openings 40 and 40'.

Through the opening 40 with no micro-tube 6 in front of it, this gas escape occurs parallel to the outer face 12 of the sheet (arrow F1), or tangentially if the sheet 1 is curved (in the case of a cylindrical burner). This gas escape through the lateral as ejection opening 40 thus takes place perpendicularly to the axis of the gas jets (arrow F3) leaving the adjoining micro-tubes 6, or quasi-perpendicularly to this direction F3 if the gas escape is tangential.

Moreover, the gas leaving the opening 40', located in front of a micro-tube 6, is also directed parallel to the face 12 or tangentially thereto then, once it hits the micro-tube 6, is then deflected outward (arrow F2), parallel to the jets leaving the micro-tubes 6 (arrows F3). In addition, and as can be seen in FIG. 1, the gas leaving the opening 40' between the two tubes 6 is also directed in the direction of the arrows F1.

Preferably, and as can be seen in FIG. 7, the generatrix G of the inner face 110 of the guiding part 30' of the deflector extends parallel to the plane P3 of the slit 2. The same is true of the other embodiments of the deflector.

Thus the gas, which tends to be deflected in a direction parallel to the surface of the deflector that it covers, is guided (arrow F1) parallel to the sheet 1 (or tangentially thereto, if it is curved).

The generatrix G could also be quasi-parallel to the plane P3 (a slight angular variation is possible), provided that the major portion of the gas flow is guided as aforementioned.

The combustion zone in a line along the axis X-X' receives not only the gas flow of the pairs of micro-tubes 6 but also the flow of gas leaving the bridges 3 located on either side. This combustion zone shown by the flame 91 in FIG. 5 is called "principal flow type."

It makes it possible to develop a strong flow through the micro-tubes 6 and the additional flows coming from the bridges 3 accentuate the adhesion of the flame to the tips of the micro-tubes 6 with an impressive performance, even for very large gas flow ranges.

Advantageously, these principal flow type combustion zones 91 are alternated with combustion zones 92 called, "secondary flow type," which extend along axes X3-X'3 and which receive only the flow of gas of the bridges 3 (arrows F1 in FIG. 1, 3 and 5).

The face-to-face encounter of these to gas flows parallel or tangential to the wall of the sheet 1 and which come from the lateral openings 40 (see arrows F1), causes combustion near the outer face 12 of the sheet 1, in a zone free of perforations. The base 920 of this flame 92 is slightly separated from the face 12, because this face is free of the heavy flow of the micro-tubes 6. Moreover, the gas which circulates on the side of the inner face 11 of the combustion grid contributes to cooling this wall, which glows red only slightly.

This bidirectional distribution of the gases (arrows F1 and F3) at the surface of the sheet 1 of the combustion grid makes it possible to perfectly control the holding of the flame and thus allows combustion within a very large flow (and hence power) variation range (greater than 40), without flashback or separation flame.

For a given burner area, the transparency coefficient plays an important role in the behavior of the combustion that is obtained, depending on the gas flow for different desired ranges of power.

With prior art burners, the greater the coefficient of transparency, the higher the maximum power. However, the minimum power will also be high if flashbacks are to be avoided. For this reason, the range of per variation is reduced for a given burner.

On the contrary, with the present invention, it becomes possible to use the burner over a very large amplitude of power variation.

The operation described with the bridges 3 is the same with the hoods 3' or the gills 3". Thus, in the absence of micro-tubes 6 between the hoods or the gills, only secondary flow type combustion zones are created, and when they are present, principal flow type combustion zones are created.

To this excellent flame-holding performance is also added a very low pollution rate with a very low emission of carbon monoxide CO.

On this topic, reference is made to the curve of FIG. 12, which represents the quantity of CO emission expressed in ppm, as a function of the burner power expressed in kW (comparative tests carried out using standard separation gas G321, used in laboratories for standardization tests).

The curve C1 was obtained with a prior art burner, the combustion grid whereof is a perforated sheet which had only a series of slits and ports but without bridges and without micro-tubes. It is observed that this CO emission curve rises progressively when the power is increased beyond 5 kW, this being so from 5 to 30 kW, thus confirming the decay in the cleanliness of combustion by separation of the flame (the CO value below 5 kW cannot be estimated because flashback occurs).

Conversely, the curve C2 shows the results obtained with the burner according to the invention having alternating patterns of dual micro-tubes and dual bridges, with the preferred dimensions given earlier. It is observed that the CO emission only varies from 0 ppm to 6 ppm for a power variation range from 1 to 30 kW. Other tests performed for NOx show that these are reduced by one-half with the burner according to the invention.

These results show distinctly the excellent flame-holding performance of the flame and the cleanliness of the combustion resulting therefrom.

One particular application of this type of burner relates to heat exchangers, and particularly those of domestic and industrial water heaters. It is possible to operate the burner according to the invention at low power, for example to produce hot water needed for central heating of a well-insulated house, and to operate it momentarily at very high powers in case of domestic hot water demand, with "flash" type production.

Other diverse and varied applications of this burner can be contemplated. Purely by way of illustration, it can be used, for example, in manufacturing lines for glass and for heat-treating it or even in cooking by surface combustion used in agri-food factories.

The invention claimed is:

1. A surface combustion gas burner including a combustion grid consisting of a sheet made of metal or refractory material, perforated with a series of slits, said sheet including a series of deflectors formed integrally with said sheet and protruding from its outer face, each deflector extending longitudinally and laterally above the totality of the surface of a slit, each deflector including a gas flow guiding part and a part connecting it to the sheet, said guiding part being spaced away from the sheet so as to form with it at least one lateral gas ejection opening, and said deflectors being arranged in pairs, so that their lateral gas ejection openings face one another, wherein the combustion takes place at the outside face of the sheet, wherein said sheet is further perforated with a series of ports extending into discharging micro-tubes, which protrude from its outer face and the central axis whereof is perpendicular to the sheet, and wherein at least some slits and ports are grouped so as to form patters, each pattern including at least one port extending into a micro-tube positioned between two slits capped by a deflector, wherein said deflector is a bridge consisting of a strip of sheet metal having a central part and two ends attached to the two ends of the slit above which it extends, said central part constituting the gas flow guiding part and the two ends constituting the part connecting to the sheet, and in that two lateral gas ejection openings are formed on either side of said bridge, wherein the width of each bridge is equal to the width of the slit above which it is positioned.

2. The gas burner according to claim 1, wherein each deflector is shaped so that the generatrix of the inner face of said gas flow guiding part is parallel to the plane of the slit above which this deflector extends.

3. The gas burner according to claim 1, wherein the ratio of the width of the bridge to the height of the lateral gas ejection opening is at least equal to 0.5.

4. The burner according to claim 1, wherein said deflector has the shape of a hood and includes a longitudinal part for guiding the gas flow, connected to the sheet by one of its longitudinal sides.

5. The burner according to claim 1, wherein said deflector has the shape of a gill.

6. The gas burner according to claim 1, wherein the ratio of the height of the portion of the discharging micro-tube protruding from the outer face of the sheet and the inner diameter of this micro-tube is comprised between 0.2 and 2, and preferably is equal to 1.

7. The gas burner according to claim 1, wherein each pattern includes two ports each extending into a micro-tube, positioned between two slits capped by a deflector, these two slits being parallel to the axis of alignment of these two ports.

8. The gas burner according to claim 1, wherein said combustion grid has a cylindrical shape.

9. The gas burner according to claim 1, wherein said combustion grid is of flat circular shape, of domed circular shape or of a dihedral shape.

* * * * *